US005532724A

United States Patent [19]

Inagaki et al.

[11] Patent Number: 5,532,724

[45] Date of Patent: Jul. 2, 1996

[54] IMAGE TRANSFER DEVICE

[75] Inventors: Minoru Inagaki; Shigeru Fukai; Michio Shinozaki; Tomoyuki Marugame; Hiroyuki Kuroki; Tatsuya Morimitsu; Tomio Andoh, all of Tokyo, Japan

[73] Assignee: Toppan Printing Co., Ltd., Tokyo, Japan

[21] Appl. No.: 111,069

[22] Filed: Aug. 24, 1993

[30] Foreign Application Priority Data

| | | | |
|---|---|---|---|
| Aug. 31, 1992 | [JP] | Japan | 4-231900 |
| Feb. 24, 1993 | [JP] | Japan | 5-061028 |
| Feb. 24, 1993 | [JP] | Japan | 5-061029 |
| Feb. 25, 1993 | [JP] | Japan | 5-061069 |
| Feb. 25, 1993 | [JP] | Japan | 5-061070 |

[51] Int. Cl.[6] ..... B41J 2/325

[52] U.S. Cl. ..... 347/213

[58] Field of Search ..... 347/171, 213; 400/120.01

[56] References Cited

U.S. PATENT DOCUMENTS 4,923,848 5/1990 Akada et al. ..... 503/227

FOREIGN PATENT DOCUMENTS 0090772 4/1989 Japan ..... 347/213

*Primary Examiner*—Huan H. Tran

*Attorney, Agent, or Firm*—Armstrong, Westerman, Hattori, McLeland & Naughton

[57] ABSTRACT

An image transfer device for transferring a clear image to a transfer object includes transport device for a transferring film, an image writing device for transferring ink from a transfer ribbon onto the film by a thermal head, a stage for fixing a transfer object, a guiding means for a inked image of the film onto the object on the stage, a transfer roller for transferring the inked image to the object, and a peel roller disposed in the vicinity of the transfer roller for peeling the transferred film from the object.

28 Claims, 15 Drawing Sheets

IMAGE TRANSFER DEVICE

FIELD OF THE INVENTION

This invention relates to an image transfer device for transferring an image comprising characters to a transfer object by pressing a heated transfer film on the object.

BACKGROUND OF THE INVENTION

Conventionally, a transfer ribbon is placed over a card, and desired image data is transferred to the card by means of a thermal head.

This ribbon is coated uniformly with a sublimating dye which is transferred to the card by the action of heat. Substances which are capable of transferring dyes are limited to for example polyester, acrylic resin and polyvinyl chloride.

Japanese Patent Laid Open No. Sho 63-81093 proposes a two step transfer process wherein other substances can be used to transfer the image. According to this process, a rotating drum and a thermal head are provided as a mechanism for transferring transfer ink to an adhesive layer on a transfer film.

In the first step, the transfer film having the adhesive layer is placed on the rotating drum, the transfer ribbon having the sublimating dye is placed over the adhesive layer of the film, and an image is written on the adhesive layer by the thermal head.

In the second step, the image on the transfer film and the adhesive layer are heated and pressed onto a card by a heating roller so as to transfer the image to the card.

In the first step of the aforesaid process, an elastic layer consisting of chloroprene rubber may be provided on the drum surface to improve the contact between the transfer film and the ribbon. However, when heat is applied, the heat is transmitted to the elastic layer through the transfer ribbon and film, and sometimes causes the elastic layer to rupture.

In the first step, if an elastic layer consisting of silicone rubber is provided on the drum surface, the elastic film does not rupture. In this case however the transfer film does not slip easily, air enters between the silicone rubber and the transfer film, and if the surface is dirty, air gaps with the transfer film can easily form. If there are such air, gaps, image quality deteriorates, little heat is transmitted from the transfer film to the elastic layer, and heat from the thermal head accumulates in the film. This may cause heat rupture of the base tape of the ribbon, and tearing.

Further, the transfer ink has thermoplasticity. Consequently in the second step, if the film and the card are in contact with each other for a long period after the image is transferred to the card, the ink on the card may be re-transferred to the film when the temperature falls, leading to a deterioration of the quality of the image on the card. Further, as the transfer film is thin, the film tends to wrinkle when the image is applied by the roller to the card by heating under pressure so that the quality of the image transferred to the card again deteriorates. The film is continuously stretched from the image writing part to the transfer part so that if any wrinkles form in the transfer part, they will extend to the image writing part which is upline from the transfer part, and continuous image transfer will then no longer be possible.

EMBODIMENTS

One embodiment of this invention will now be described in more detail with reference to the attached drawings.

Figure 1:
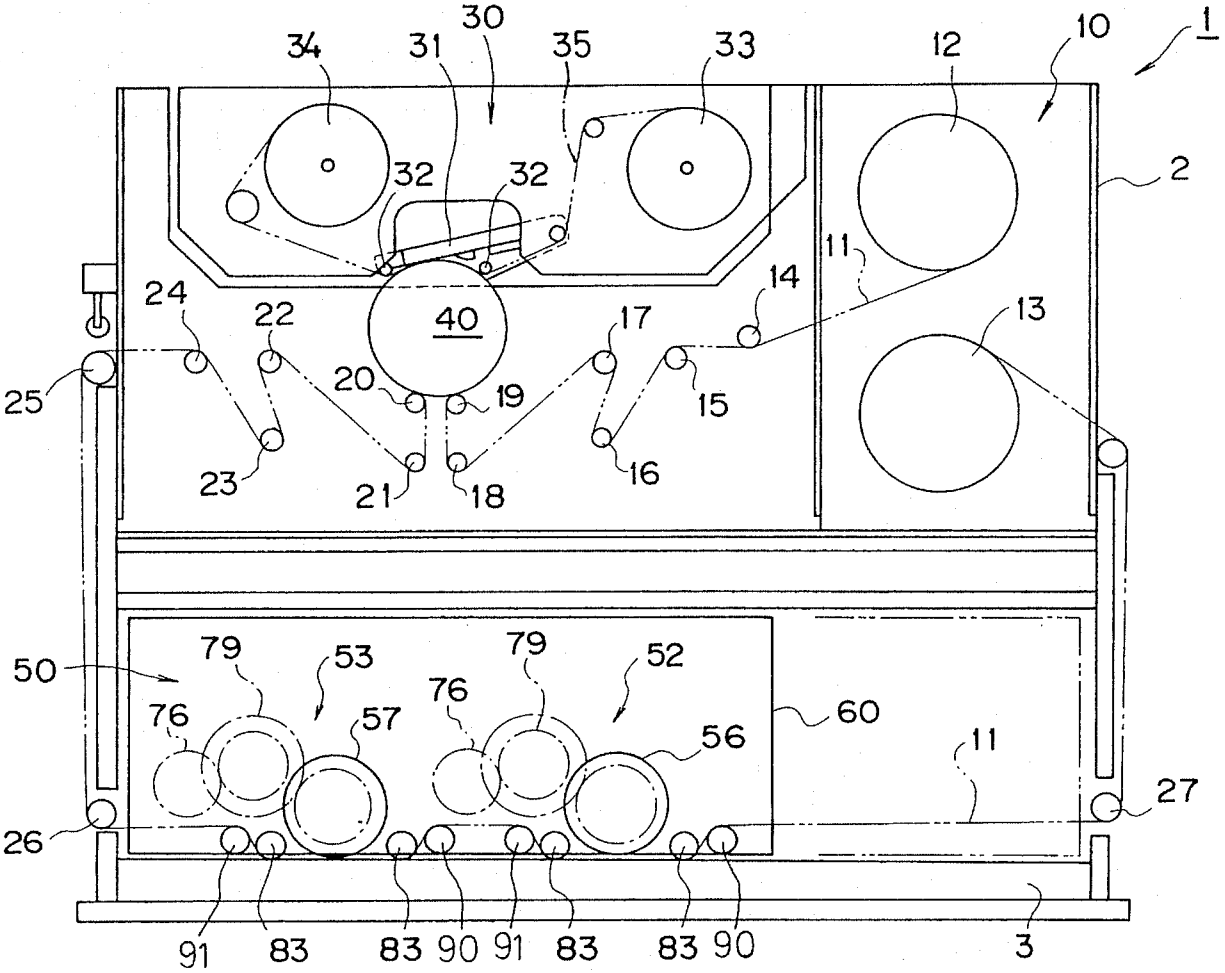
FIG. 1 is a schematic view of an image transfer device.

FIG. 1 is a schematic view of an image transfer device according to one embodiment of this invention.

A main body 2 comprises a film transport part 10 which transports a transfer film 11, an image writing part 30, and a transfer part 50.

Figure 2:
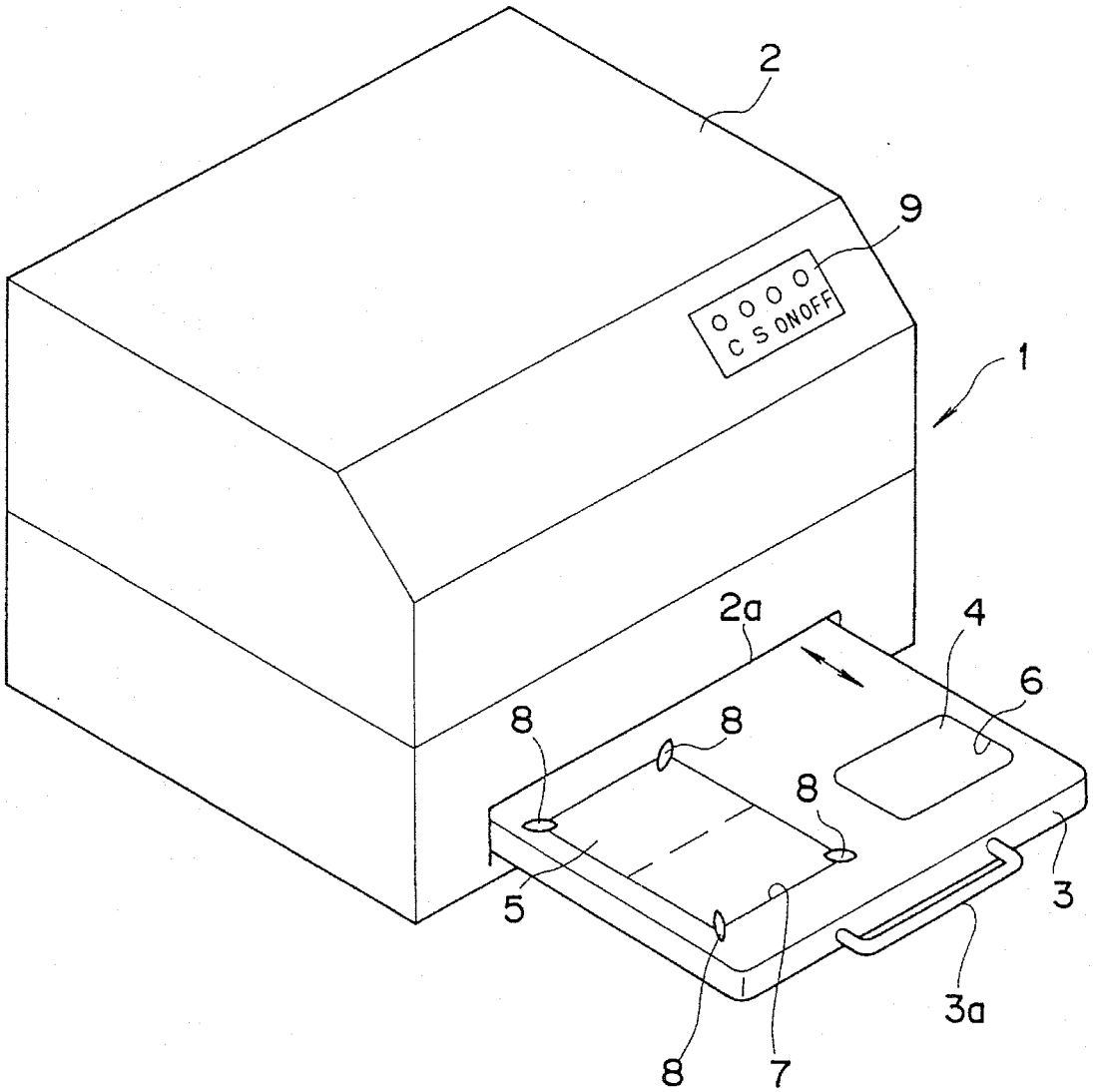
FIG. 2 is a perspective view of the image transfer device shown in FIG. 1.

As shown in FIG. 2, the image transfer device 1 comprises the main body 2 and a stage 3. The stage 3 slides in and out from a hole 2*a* of the main body 2. According to this embodiment, shallow depresssions 6, 7 are formed in the stage 3 which accommodate a card 4 consisting mainly of a synthetic resin, and a booklet 5 like as a passport consisting mainly of paper. The depressions 6, 7 are of such shapes that the card 4 and booklet 5 fit into them, and are of such depths that the card 4 and booklet 5 sink into them approximately halfway. The thicknesses of the card 4 and booklet 5 are different, and the height of the surface to which an image is transferred may be suitably set by adjusting the depths of the depressions 6, 7. Fixing tags 8 are provided on the edge of the depression 6 into which the booklet 5 fits, these tags 8 holding the booklet 5 open at a page onto which it is desired to transfer an image. The stage 3 is provided with a handle 3*a*. The control unit of the main body of the device comprises a control panel 9 which is provided with an ON/OFF switch, card switch C and booklet switch S.

As shown in FIG. 1, the film transport member 10 is provided with a supply reel 12 on which the transfer film 11 consisting of a transparent film is wound, and a take-up reel 13 for winding this transfer film 11.

An adhesive layer on which an image is written by a thermal head 31 and transfer ribbon 35, is formed on one side of the transfer film 11.

After the transfer film 11 has been stretched from the supply reel 12 to the image writing part 30 and transfer part 50, it is wound onto the take-up reel 13.

According to this embodiment, the transfer film 11 may be paid out from the supply reel 12 to the take-up reel 13, or paid out from the take-up reel 13 to the supply reel 12.

The transfer film 11 paid out from the supply reel 12 is wound on a rotating drum 40 via a first guide roller 14, second guide roller 15, upline tension roller 16, third guide roller 17, fourth guide roller 18 and contact roller 19.

The transfer film 11 which is wound on the rotating drum 40 is transported to the transfer part 50 via a contact roller 20, 5th guide roller 21, 6th guide roller 22, downline tension roller 23, 7th guide roller 24, upper roller 25 and lower roller 26, and is then wound from the transfer part 50 onto the take-up reel 13 via the lower roller 26.

Inside the image writing part 30, the transfer film 11 is wound onto the rotating drum 40, and while the film 11 is fixed by the contact rollers 19, 20, the rotating drum 40 rotates forwards and backwards 4 times.

When the rotating drum 40 is rotating counterclockwise, ink on the transfer ribbon 35 is transported to the transfer film 11 by the thermal head 31.

When the rotating drum 40 is rotating clockwise, the contact rollers 32, 32 separate from the drum 40, the thermal head 31 separates from the drum 40, and the transfer ribbon 35 is wound from a supply reel 33 to a take-up reel 34.

The image writing part 30 transfers a color image to the transfer film 11 on the drum 40 by means of the thermal head 31 and transfer ribbon 35.

The transfer ribbon 35 comprises a base tape, and a heat transfer ink on this base tape.

The dye of the heat transfer ink may for example be a sublimating dye of the anthraquinone type, azo type or naphthaquinone type. In addition, a wax type heat transfer material may also be used comprising a binder such as paraffin wax or carnuba wax mixed with a dye and/or pigment. There is no particular limitation on these dyes and pigments, specific examples being carbon black, crystal violet, kayacet blue and methylene blue. According to this embodiment, different regions of the transfer ribbon 35 are coated with magenta, yellow, cyan and black paint, and are wound from the supply reel 33 to the take-up reel 34 via the thermal head 31.

Figure 17:
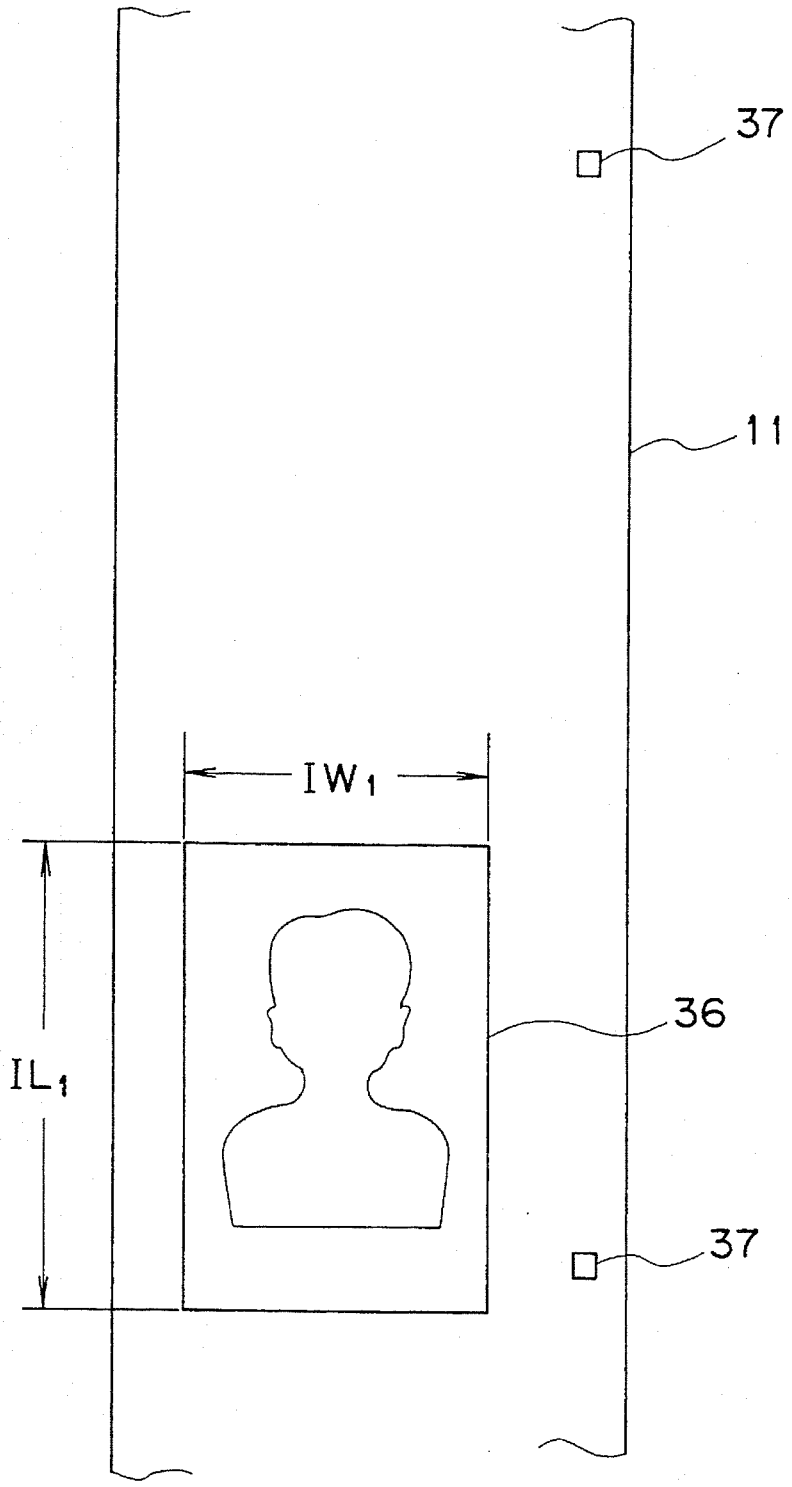
FIG. 17 is a plan view of a transfer film whereon a color image is formed.

As shown in FIG. 17, images formed by magenta, yellow, cyan, black paint are progressively superposed on the transfer film 11 so as to form a color image 36. The symbol 37 in FIG. 17 is an image identification mark comprising of hologram.

Figure 3:
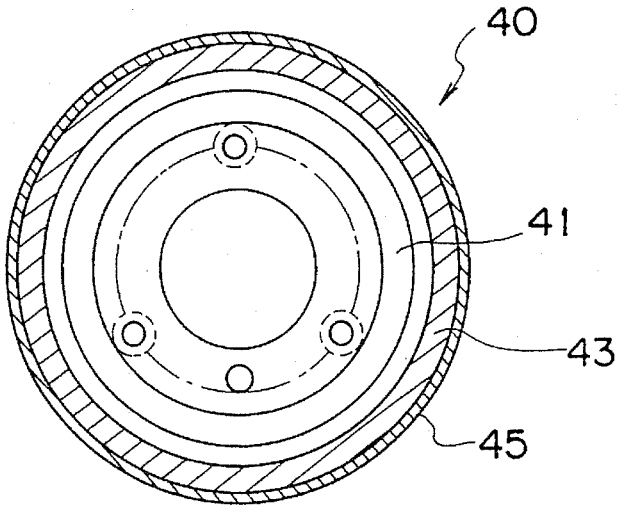
FIG. 3 is a view showing a vertical section through a rotating drum.
Figure 4:
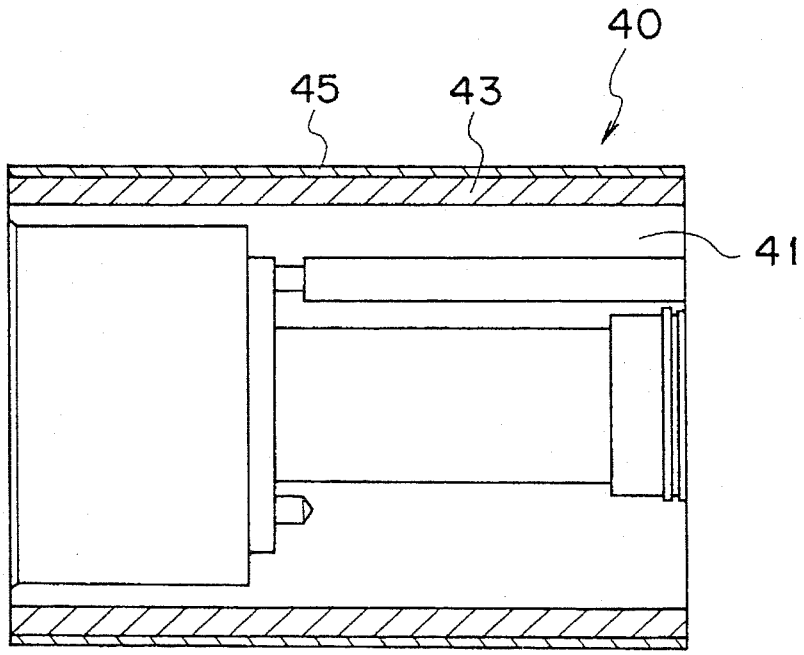
FIG. 4 is a view showing a horizontal section through the rotating drum shown in FIG. 3.

The rotating drum 40 of the image writing part 30, as shown in FIGS. 3 and 4, comprises a cylindrical drum body 41, an elastic layer 43 covering the outer circumference of the drum body 41, and a cover layer 45 superposed the elastic layer 43.

There is no particular limitation on the material of which the drum body 41 consists provided it has the desired rigidity, specific examples being metals such as stainless steel, aluminum and brass, resins such as polycarbonate, polyacetal and polyamide, and ceramics such as alumina.

The elastic layer 43 consists of a silicone elastomer.

The silicone elastomer has an excellent heat resistance and a suitable elasticity. The elastic layer 43 therefore confers elasticity on the surface of the drum 40, and improves the contact between the drum 40 and the film 11 when heat is being transferred.

The silicone elastomer of which the elastic layer 43 is comprised may be LTV (addition reaction type, liquid silicone elastomer), RTV (condensation reaction type, room temperature effect silicone elastomer), or HTV (heat vulcanized type, silicone elastomer).

Further, the silicone elastomer may be a non-foam type, or a foam type in order to confer flexibility.

The elastic layer 43 should have a thickness of 0.5–50 mm, but more preferably has a thickness of 1–10 mm.

The cover layer 45 consists of a heat-resistant polymer compound.

Specific examples of this heat-resistant compound are polytetrafluoroethylene(PTFE), the copolymer of tetrafluoroethyleneand petrofluoroethylene, polyethylenenaphthalate, polyimide, polyamidoimide, polyetherimide and polyphenylenesulfide.

The cover layer 45 may be given electrical conduction properties by adding an electrically conducting filler to the aforesaid resins. Examples of such electrically conducting fillers are non-metal fillers such as carbon, sodium alkylbenzenesulfonate or polyvinylcarbazol, and metal fillers such as indium tin oxide, Ag compounds and Sn compounds. By giving electrical conduction properties to the cover layer 45, adhesion of the film 11 to the drum 40 by static electricity can be prevented.

The cover layer 45 should have a thickness of 10–1000 μm, but more preferably has a thickness of 50–500 μm.

As the cover layer 45 has an excellent heat resistance and a small frictional coefficient, the film 11 is supported on the surface of the drum 40 uniformly and in intimate contact with it, so that a clear image is formed by heat transfer on the film 11.

The aforesaid heat-resistant polymer compound may be formed such that its surface roughness is 2–5 μm. This permits the film 11 to be supported on the surface of the drum 40 uniformly and in intimate contact with it, and also has an added advantage in that it permits heat conducted from the thermal head 31 to be effectively dissipated. Further, as the cover layer 45 has excellent soiling resistance, air gaps do not occur between the film 11 and drum 40 due to dirt adhering to the surface.

A clear image is therefore formed on the film 11, and as the heat of the thermal head 31 is smoothly dissipated, tearing of the ribbon 35 is prevented. The elastic layer 43 on the drum 40 has both elasticity and heat resistance, while the cover layer 45 has excellent heat resistance, a low frictional coefficient and excellent anti-soiling properties. As a result, the running properties of the film 11 are improved, dirt does not adhere to it easily, and it can be made to adhere to the drum 40 uniformly in intimate contact with the drum.

Due to this cover layer 45, heat conducted from the thermal head 31 via the ribbon 35 and film 11 can be effectively absorbed, tearing of the ribbon 35 can be prevented, and clear images can be continuously formed by heat transfer.

According to the aforesaid embodiment, the support member supporting the film 11 and ribbon 35 was cylindrical, e.g. the drum 40. The support member is not however limited to a drum, and it may for example have the shape of a flat plate or a belt.

Figure 5:
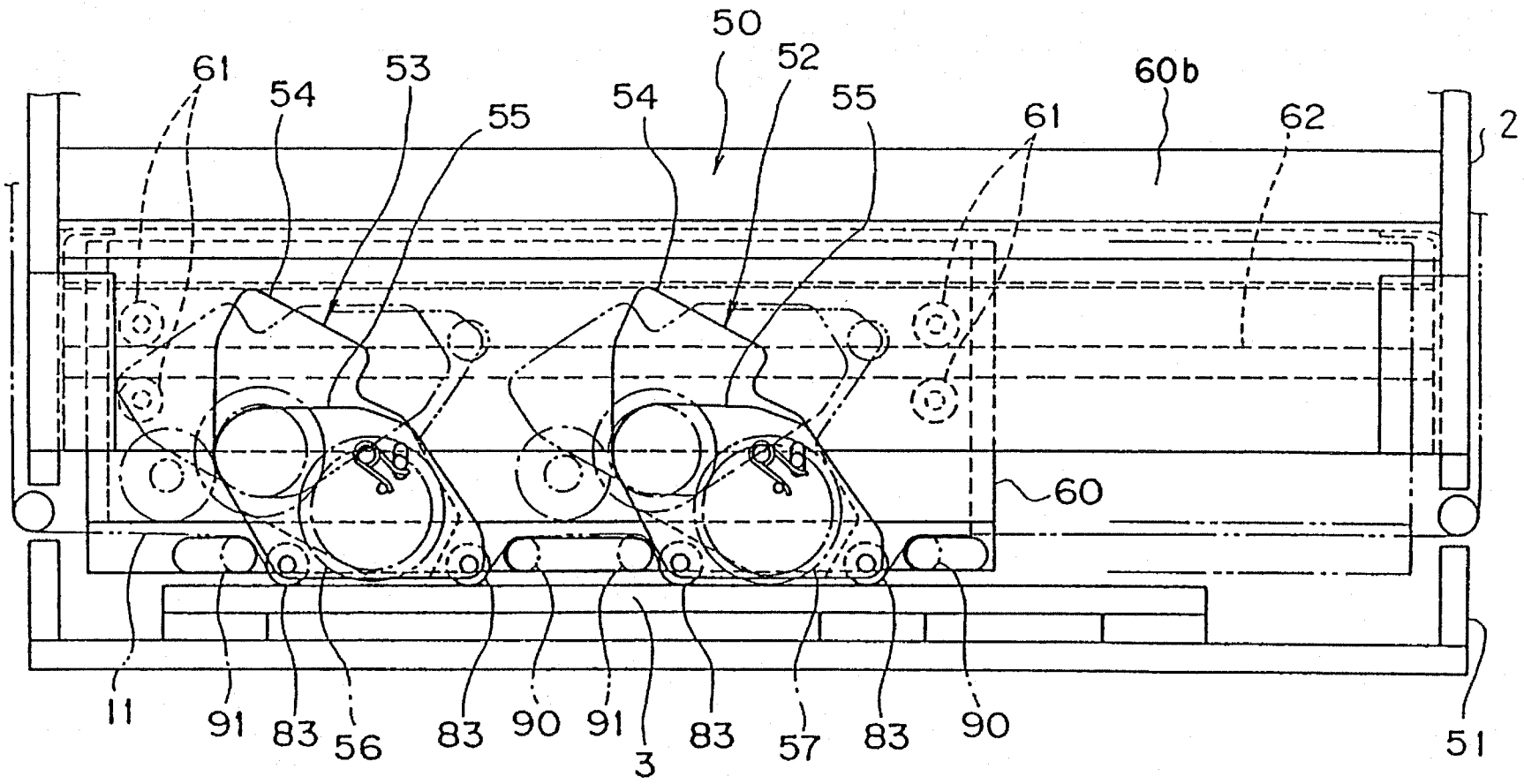
FIG. 5 is a lateral view of an object transfer part.
Figure 6:
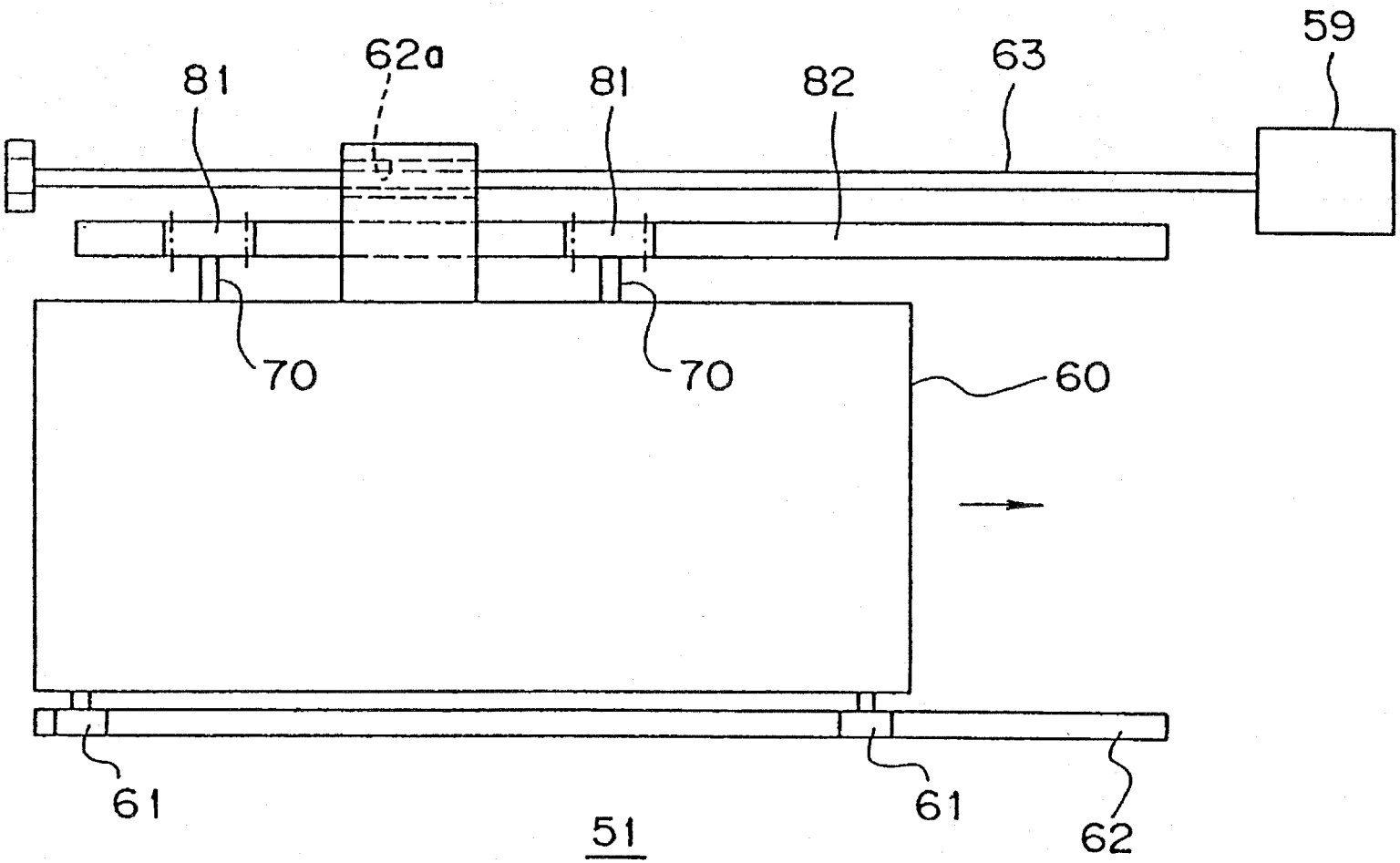
FIG. 6 is a plan view of a moving frame.
Figure 7:
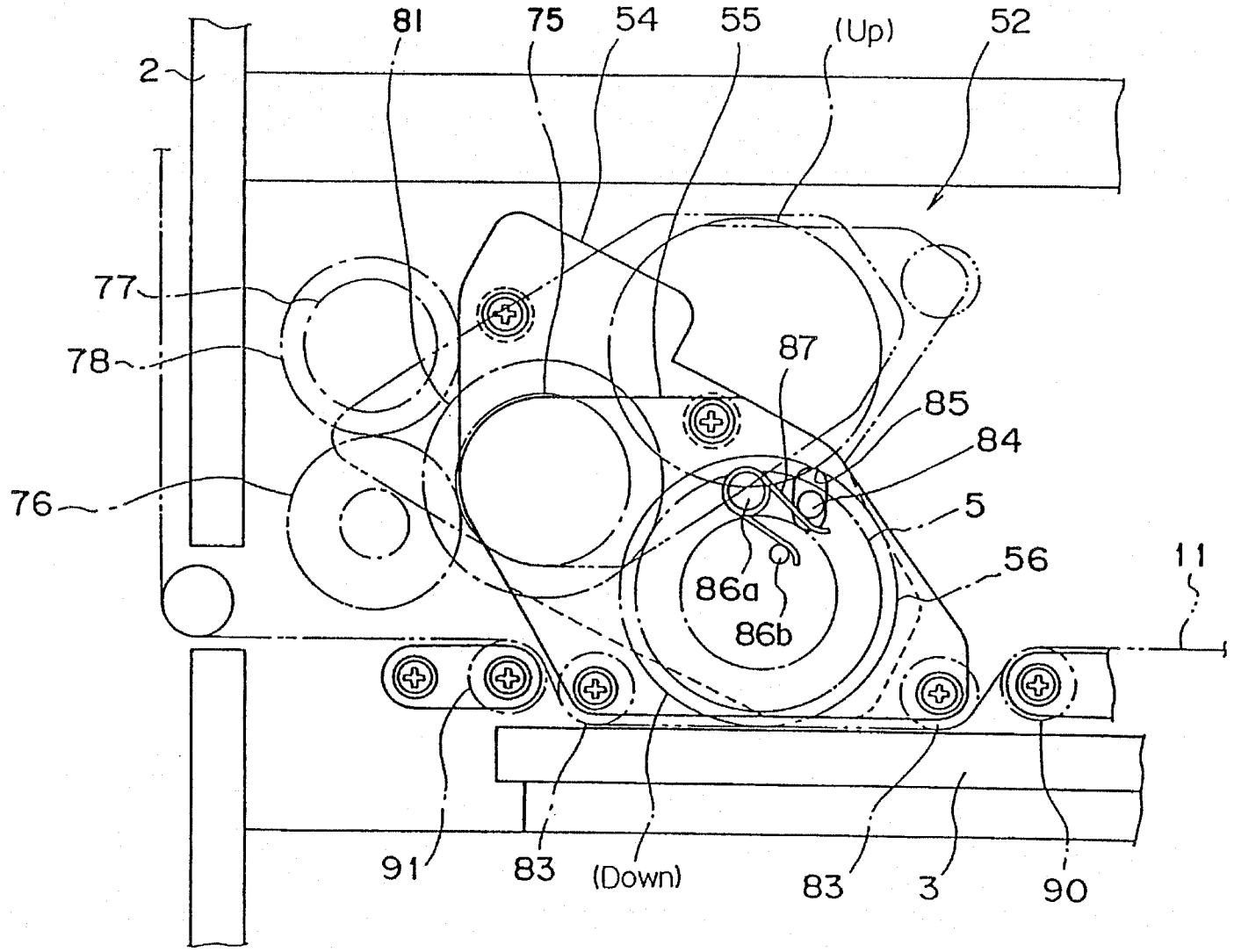
FIG. 7 is an enlarged lateral view of the essential features of a transfer unit.

FIG. 5 is a lateral view of an object transfer part. FIG. 6 is a plan view of a moving frame. FIG. 7 is an enlarged lateral view of the essential features of a transfer unit.

Figure 8:
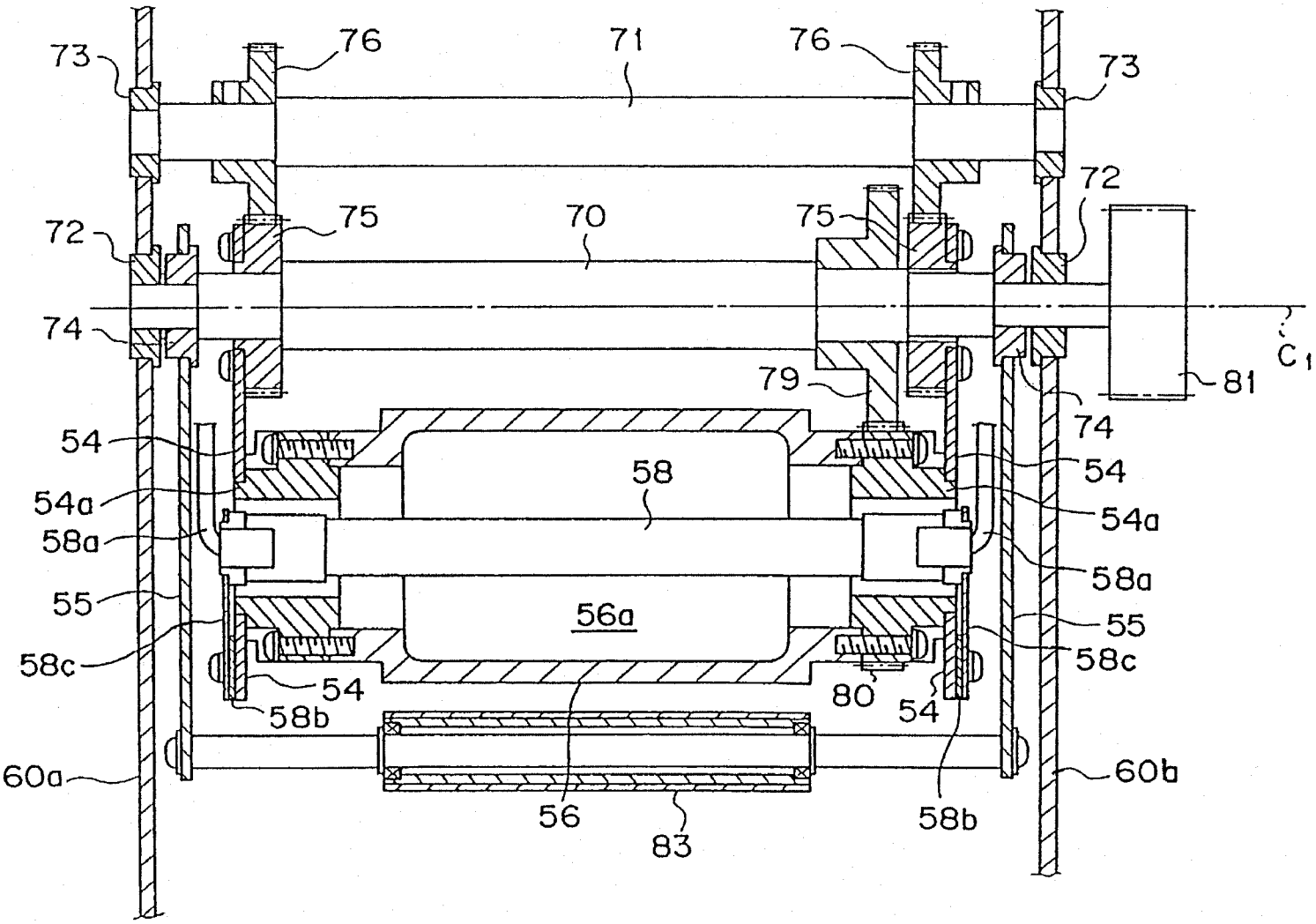
FIG. 8 is a cut-away view of the transfer unit shown in FIG. 7.
Figure 9:
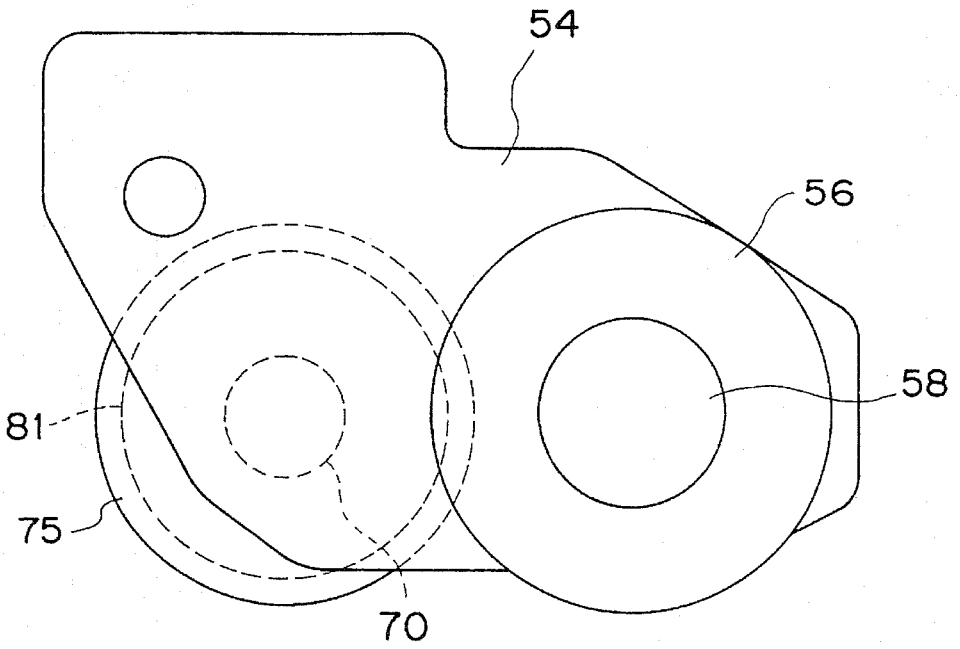
FIG. 9 is a front view of a first arm.
Figure 10:
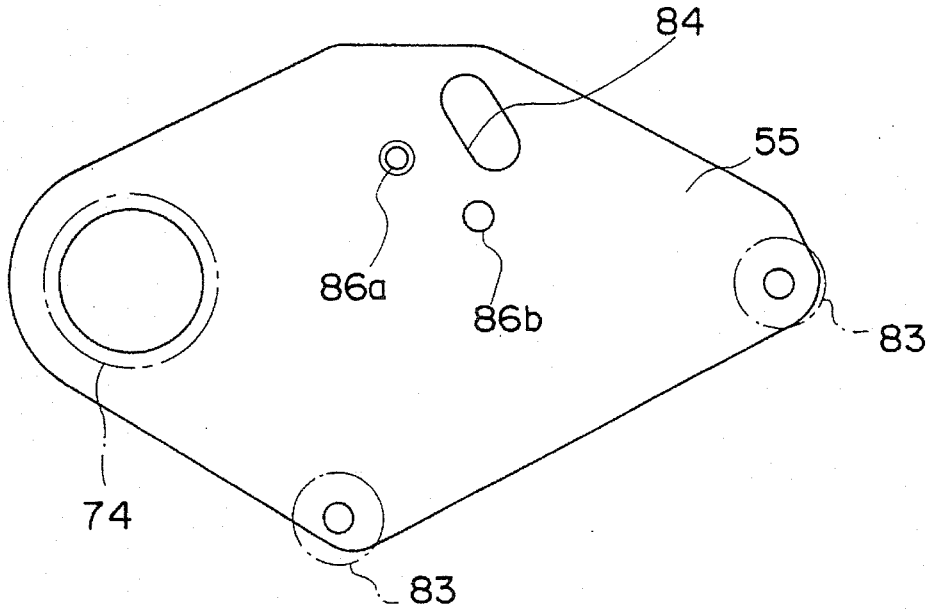
FIG. 10 is a front view of a second arm.
Figure 11:
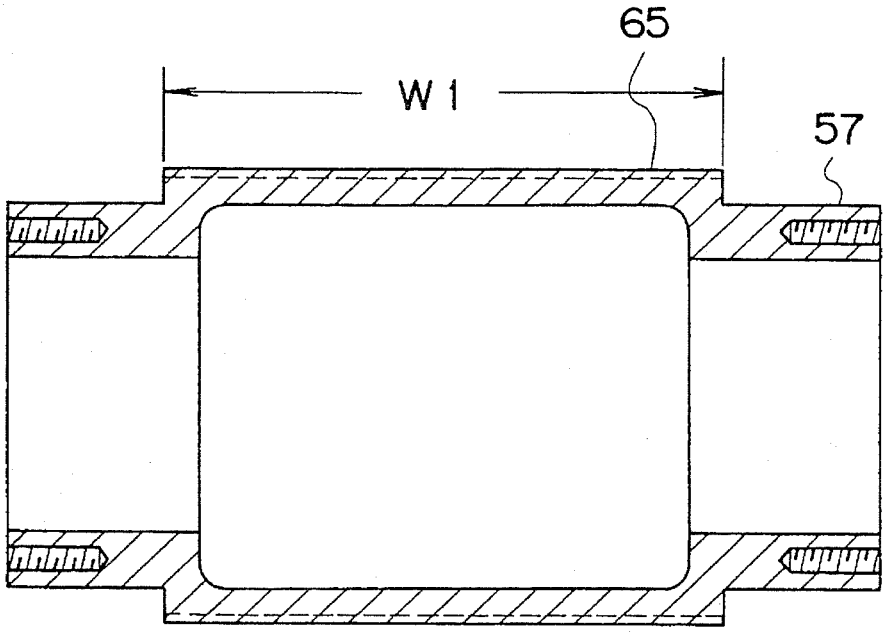
FIG. 11 is a lateral view of a transfer roller for use with a card.
Figure 12:
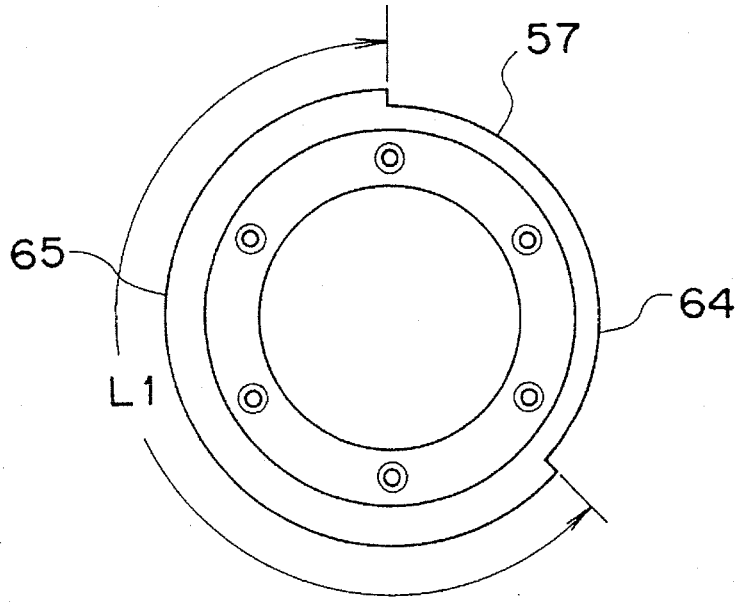
FIG. 12 is a horizontal section through the transfer roller for use with a card.
Figure 13:
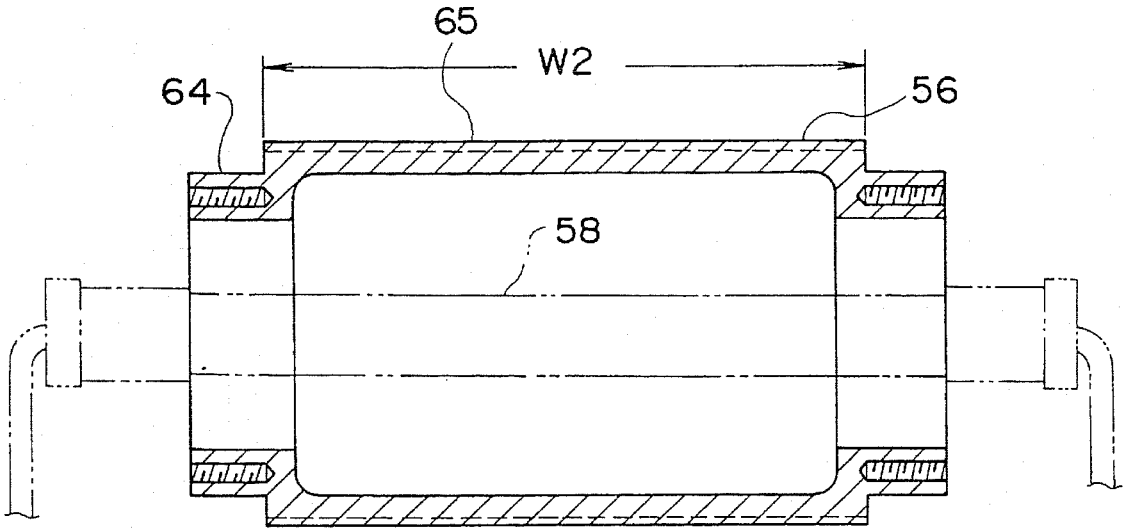
FIG. 13 is a horizontal section through a transfer roller for use with a booklet.
Figure 14:
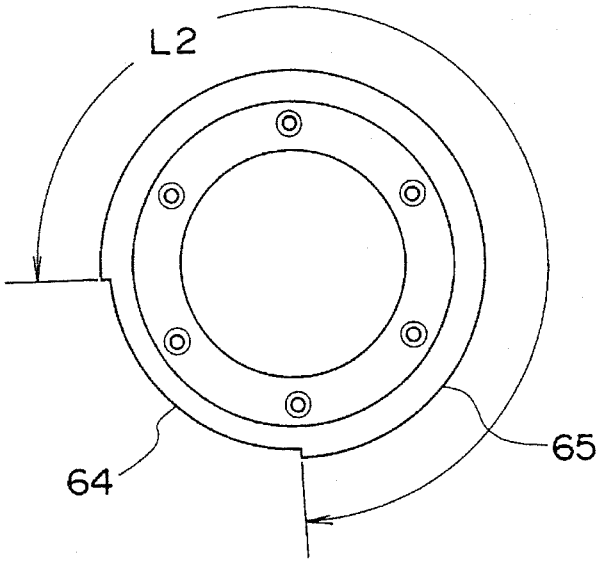
FIG. 14 is a lateral view of the transfer roller for use with a booklet.

FIG. 8 is a cut-away view of the transfer unit shown in FIG. 7.

The transfer part 50 is a part which transfers a color image, which has already been transferred to the film 11, to a card 4 or booklet 5.

The transfer part 50 is mounted on a rectangular moving frame 60 which moves horizontally with respect to a frame 51 comprising the main body 2.

The transfer part 50 consists of a transfer unit 52 for transferring images to the booklet 5, and a transfer unit 53 for transferring images to the card 4.

Although the transfer units 52, 53 have different transfer rollers 56, 57, the units 52, 53 have the same transfer roller support mechanism and swing mechanism. The description of the support mechanism and swing mechanism for the transfer roller 56 may therefore also be understood as applying to the transfer roller 57.

The support mechanism and swing mechanism for the transfer roller 56 will now be described.

The transfer unit 52 comprises a first axis 70, second axis 71, first arm 54, second arm 55 and the transfer roller 56.

The first axis 70 and second axis 71 are supported by a pair of lateral walls 60*a*, 60*b* comprising the moving frame 60.

The first axis 70 is supported on a bearing 72 of the lateral wall 60*a*.

A bearing 74, gear 75, gear 79 and pinion 81 are supported on the first axis 70.

The bearing 74 is supported by the first axis 70 such that it is free to rotate.

The gear 75 is supported by the first axis 70 such that it is free to rotate.

The gear 79 is fixed on the first axis 70.

The pinion 81 is fixed on the first axis 70.

The first arm 54 is fixed on the gear 75 of the first axis 70.

The second arm 55 is fixed on the bearing 74 of the first axis 70.

The gear 79 of the first axis 70 engages with a gear 80 fixed to one end of the transfer roller 56.

The pinion 81 of the first axis 70 engages with a rack 82 fixed to a frame 51 comprising the base of the main body 2. When the moving frame 60 moves, the pinion 81 is rotated by the rack 82 and the first axis 70 rotates. Due to the rotation of the first axis 70, the gear 79 rotates, the gear 80 rotates and the transfer roller 56 rotates.

A gear 76 which engages with the gear 75 is fixed on the second axis 71.

FIG. 7 shows a DC motor 77 which swings the rollers 56, 57. The DC motor 77 is attached to a side of the moving frame 60. A gear 78 is fixed to the output shaft of the motor 77. The gear 78 rotates the second axis 71 via the gear 76.

The torque of the DC motor 77 is transmitted to the gear 75 by the gears 78, 76.

The gear 75 freely rotates with respect to the first axis 70, and the first arm 54 fixed to a side of the gear 75 swings up and down about the first axis 70 as center. When the first arm 54 swings up and down, the roller 56 moves between an upper retracted position (UP) and a lower transfer position (DOWN).

A set of pressure rollers 83, 83 is supported free to rotate on the second arm 55. The set of pressure rollers 83, 83 is aligned parallel to the rotation axis of the roller 56, and is installed near to the roller 56.

The first arm 54 and second arm 55 perform a concerted action due to a pin 84 and hole 85. The pin 84 projects from the first arm 54, and the hole 85 forms an opening in the second arm 55. The second arm 55 rotates about the first axis 70 as center. A spring 87 is held on a pin 86*a* of the second arm 55. One end of the spring 87 is supported by a pin 86*b*, the other end of the spring 87 being supported by the pin 84. The spring 87 exerts an elastic force which tends to push the first arm 54 and the second arm 55 apart from each other.

Due to the rotation of the motor 77, the first arm 54 swings from its retracted position (UP) to its transfer position (DOWN), thereby compressing the spring 87 so that it pushes the second arm 55 over. The second arm 55 therefore presses the pressure rollers 83, 83 into contact with the film 11 on the stage 3, and the transfer roller 56 then moves into position above the film 11.

Peel rollers 90, 91 which separate the film 11 from the card 4 are disposed on the moving frame 61 such that they are free to rotate. The peel rollers 90, 91 are provided on both the transfer unit 52 and transfer unit 53. The peel rollers 90, 91 are situated further downline than the pressure rollers 83 which are situated downline from the film 11, and they are installed in a position slightly above the card 4 when the roller 56 is in the transfer position (DOWN).

The distances between the peel rollers 90, 91 and pressure rollers 83 are made short so that the film 11, to which image transfer by the roller 56 has been completed, can be separated from the card 4 before the temperature cools.

According to this embodiment, the peel rollers 90, 91 are set such that there is an acute angle between the film 11 which extends from the pressure roller 83 to the peel rollers 90, 91, and the surface of the card 4.

Guide rollers 94 are also installed free to rotate at the front end of the pressure roller 83 on both the front transfer unit 52 and rear transfer unit 53 of the moving frame 60.

As shown in FIG. 5, one set of upper and lower rollers 61, 61 is installed at the front and rear on the side of the moving frame 60, a guide rod 62 being sandwiched between each set. The frame 60 is guided by the guide rod 62 and the upper, lower rollers 61, 61, and it slides in a horizontal direction with respect to the frame 51. A nut 62*a* projects from the side of the frame 60. A ball screw 63 connected to the output shaft of a pulse motor 59 is screwed into the nut 62*a*, and the frame 60 moves in a straight line driven by the pulse motor 59.

The roller 56 is supported such that it is free to rotate via a bearing 54*a* of the first arm 54. A gear 80 is formed on the outer circumference of the bearing 54*a*.

A space piece 56*a* is formed inside the roller 56, a halogen lamp heater 58 being installed inside this space piece 56*a*. The halogen lamp heater 58 is heated via a conductor 58*a*. The halogen lamp heater 58 is supported by an arm 58*c*, this arm 58*c* being fixed to the first arm 54 via a spacer 58*b*.

The rollers 56, 57 have a shape which corresponds to that of the object to which it is desired to transfer an image.

The roller 56 is used for transferring an image to the card 4, while the roller 57 is used for transferring an image to the booklet 5.

A small cylindrical surface 64 not in contact with the film 11 and a large, cylindrical pressing surface 65 are formed on the outer circumference of each of the rollers 56, 57. The width W1 and length L1 of the pressing surface 65 is identical to the width W1 and length L1 of a color image so as to correspond with the image region which it is desired to transfer.

There is no particular limitation on the material of the rollers 56, 57 provided that it has a suitable rigidity, specific examples being metals such as stainless steel, aluminum and brass, resins such as polycarbonate, polyacetal and polyamide, and ceramics such as alumina.

According to this embodiment, the entire inner wall surfaces of the rollers 56, 57 are blackened by coating them with black paint. This paint must be heat-resistant, and may for example be a silicone resin type paint.

The rollers 56, 57 which are heated by the halogen heater 58 radiate heat to the outside. By coating the inner wails of the rollers 56, 57 with black paint, damage of the heater 58 due to reheating is prevented, and unevenness in the heating of the rollers 56, 57 is eliminated. The whole image area of the film 11 can therefore be heated uniformly by the rollers 56, 57, and the image quality is improved.

Uneven heating also causes the film 11 to wrinkle, therefore by eliminating such unevenness, wrinkling of the film 11 can also be prevented.

The pressing surface 65 is a part which applies heat and pressure to the film 11. The width W1 and length L1 of the pressing surface 65 of the card transfer roller 56 coincides with the width and length of the color image to be transferred to the card 4, whereas the width W2 and length L2 of the pressing surface 65 of the booklet roller 57 coincides with the width and length of the color image to be transferred to the booklet 5.

Figure 15:
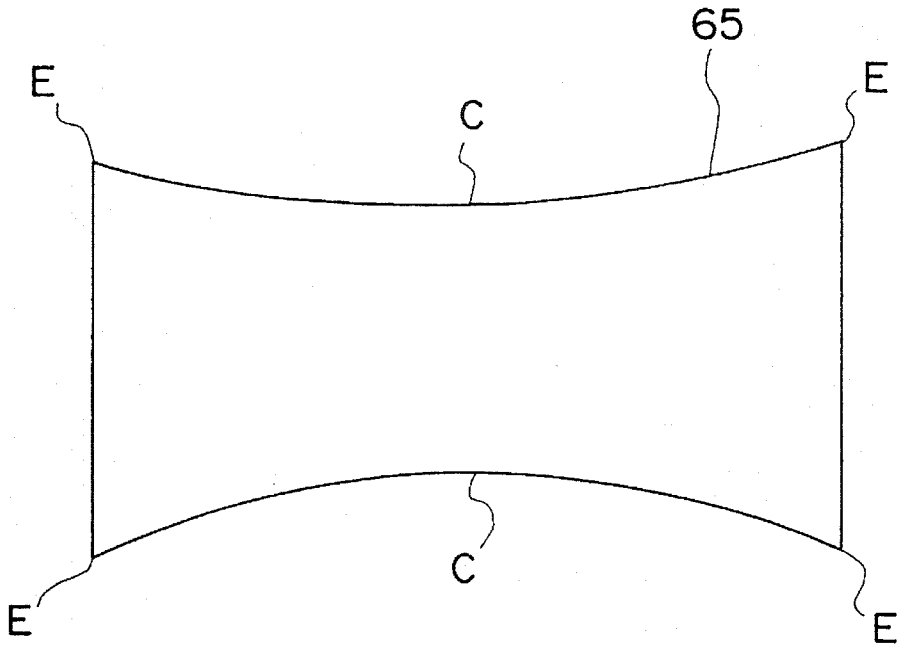
FIG. 15 is a plan view of a transfer roller whereof the pressing surface is concave.

The pressing surface 65 comprises a central part C of smaller diameter than that of its end parts E perpendicular to the axial direction of the rollers 56, 57, the outer diameter increasing progressively from C to E so as to form a concave surface as shown in FIG. 15.

Figure 16:
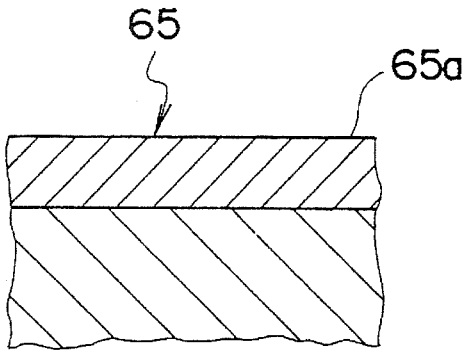
FIG. 16 is a section showing the laminated structure of the surface of the transfer roller in FIG. 15.

In order to improve slip with respect to the film 11, the pressing surface 65 is covered with a cover layer **65*a* consisting of a fluorinated polymer compound as shown in FIG. 16**.

Specific examples of this fluorinated polymer compound are polytetrafluoroethylene(PTFE), and the copolymer of tetrafluoroethylene and perfluoroalkylvinylether.

The cover layer **65*a*** may also be given electrical conduction properties by addition of an electrically conducting filler to the aforesaid resins, examples of such fillers being non-metal fillers such as carbon, or metal fillers such as Sn compounds or Ag compounds.

By giving electrical conduction properties to the cover layer **65*a*, adhesion of the film 11 to the roller 31** due to static electricity is prevented.

This cover layer **65*a*** should have a thickness of 2–100 μm, but more preferably has a thickness of 3–25 μm.

The cover layer **65*a*** may be formed by powder coating or molding, non-electrolytic plating or tube coating.

As the pressing surfaces 65 of the rollers 56, 57 according to this embodiment have a concave shape whereof the outer diameter is smaller in the central region C than in the end regions E, and this pressing surface 65 is coated with a cover layer **65*a* consisting of a fluorinated polymer compound, the film 11 is transported smoothly in close contact with the pressing surface 65, and as a force acts on the film 11 in the width direction due to the concave surface, wrinkling of the film 11 is effectively prevented, and the color image is transferred clearly from the film 11** to the object.

As the cover layer **65*a* has an excellent heat resistance and a small frictional coefficient, the film 11 is pressed in close contact by the pressing surface 65. Further, as it has an excellent soiling resistance, air gaps between the film 11 and the pressing surface 65** due to surface dirt do not occur, and the image is transferred clearly.

Further, as the pressing surface 65 for pressure heating of the film 11 and the smaller surface 64 which does not come into contact with the film 11 are formed on the outer circumferences of the rollers 56, 57, a part of the image information on the film 11 can be selectively transferred to the object. In this process, the edges of the image transferred to the object are transferred with particular clarity.

In this embodiment, the case has been described wherein the inner walls of the rollers 56, 57 are blackened, however this blackening may be omitted depending on the material of the rollers 56, 57, and the ratio of surface areas of the inner walls of the rollers 56, 57, to that of the outer surface of the heater 58. The stage 3 moves in and out of the main body 2 from a perpendicular direction with respect to the travel direction of the film 11.

In FIG. 2, when the booklet 5 is placed in a position to the left of the stage 3 and an operator switches a booklet switch (S) ON, the left-hand booklet transfer roller 57 applies heat and pressure to the transfer film 11 and booklet 5 so that image data consisting of character information and pictures is transferred to the booklet 5.

The card 4 is on the right of the stage 3. If the operator presses a card switch (C) when there is no booklet 5 on the left, the booklet transfer roller 57 withdraws to the position shown by the double dotted line, and the card transfer roller 56 applies heat and pressure to the film 11 and card 4 which are sandwiched between the roller 56 and the stage 3.

It is not predetermined whether the card 4 or booklet 5 is to be mounted on the stage 3, the transfer roller to be used being selected when performing transfer. The simplest selection method is to leave the choice to the operator, either the card switch (C) or booklet switch (S) being pressed depending on the object on the stage 3.

The selection of the rollers 56, 57 may also be performed automatically. For automatic selection, an optical source and an optical sensor for detecting reflected light are installed at the respective positions of the card 4 and booklet 5 on the stage 3. The outputs of these sensors are input to a collimator having a reference value for the reflected light, and the output of the collimator is input to a switch circuit which switches on either the card switch (C) or the booklet switch (S).

Next, the action of this transfer part 50 will be described.

A color image 36 formed by the image writing part 30 is transported to the transfer part 50 by the supply reel 12 and take-up reel 13.

In the transfer part 50, transport of the film 11 stops at a position wherein the color image 36 formed by the image writing part 30 is close to a predetermined position facing the object.

The first arm 54 is swung from its retracted position (UP) to its transfer position (DOWN) by the DC motor 77 depending on the operation of the card switch C or booklet switch S. One or both of the pressure rollers 83 of the transfer unit 52 or 53 then presses or press the film 11 on the stage 3, this roller or rollers being situated above the film 11. Next, the moving frame 51 is moved by the pulse motor 59, and the transfer roller 56 or 57 is rotated by engaging with the pinion 81 and rack 82.

First, one end of the pressing surface 65 of the roller 56 or 57 coincides with one end of the image region of the film 11, heat and pressure begin to be applied by the pressing surface 65 to the transfer object of the film 11, and the color image 36 is transferred to the card 4 or booklet 5 by rotation of the roller 56 or 57 accompanying the movement of the moving frame 51.

When the other end of the pressing surface 65 of the roller 56 or 57 coincides with the other end of the image region of the film 11, transfer of the color image 36 is completed.

After transfer is completed, the small surface 64 of the roller 56 or 57 is situated above the film 11. The frame 60 then moves to the right, and the peel rollers 90, 91 pass over the object so that the part of the film 11 heated and pressed on the card 4 or booklet 5 is peeled off by these rollers 90, 91. The roller 56 or 57 is swung into its upper retracted position (UP) by the DC motor 77 after it has rotated by a predetermined amount, and the moving frame 60 moves back to the left to its original position.

The film 11 is transported to the take-up reel 13. After the film 11 has stopped, the operator takes the stage 3 out of the body 2, and removes the card 4 or booklet 5 on which the color image 36 is formed. The next card 4 or booklet 5 is then positioned on the stage 3, and the stage 3 is re-inserted in the body 2.

Color images 36 are then transferred progressively to the card 4 and booklet 5 as described hereintofore.

According to this embodiment, the peel rollers 90, 91 are arranged such that they are free to rotate in the frame 60. By making use of the motion of the frame 60 during image transfer, therefore, the part of the film 11 which has been transferred can be peeled off the card 4 or booklet 5 so that a clear color image 36 is left.

As the pressure rollers 83 were provided between the transfer roller 56 or 57 and the peel rollers 90, 91, the angle with respect to the upper surface of the stage 3 of the film 11 which extends from the rollers 83 to the peel rollers 90, 91, can be arbitrarily set. According to this embodiment, if this angle is set to a small value, the peeling of the film 11 by the rollers 90, 91 proceeds smoothly.

According to this embodiment, the pinion 81 and rack 82 are permanently engaged, hence however many times the frame 60 is caused to move back and forth, the region of the surface 65 of the roller 56 or 57 which is in contact with the stage 3 is always the same.

Once the rotation angle of the rollers 56, 57 has been adjusted with respect to the card 4 or booklet 5 on the stage 3, therefore, the adhesive layer of the transfer film 11 is transferred accurately to the desired part of the card 4 or booklet 5, and a clear image 36 can be transferred.

Further, since the rollers 56 and 57 can swing away from or nearer to the transfer object as in this embodiment, the transport of the transfer film 11 after transferring the color image, or the insertion of the stage 3 into the body 2 and its removal from same, are rendered easier. In this case, if a gear mechanism is further provided which permanently connects the pinion 81 and roller 56 or 57 as according to this embodiment, there is no adhesion of the adhesive layer of the transfer film 11 other than with the part of the object on which the image is to be formed, and a clear image can therefore be obtained.

Next, an image transfer device according to another embodiment of this invention will be described with reference to the drawings.

Figure 18:
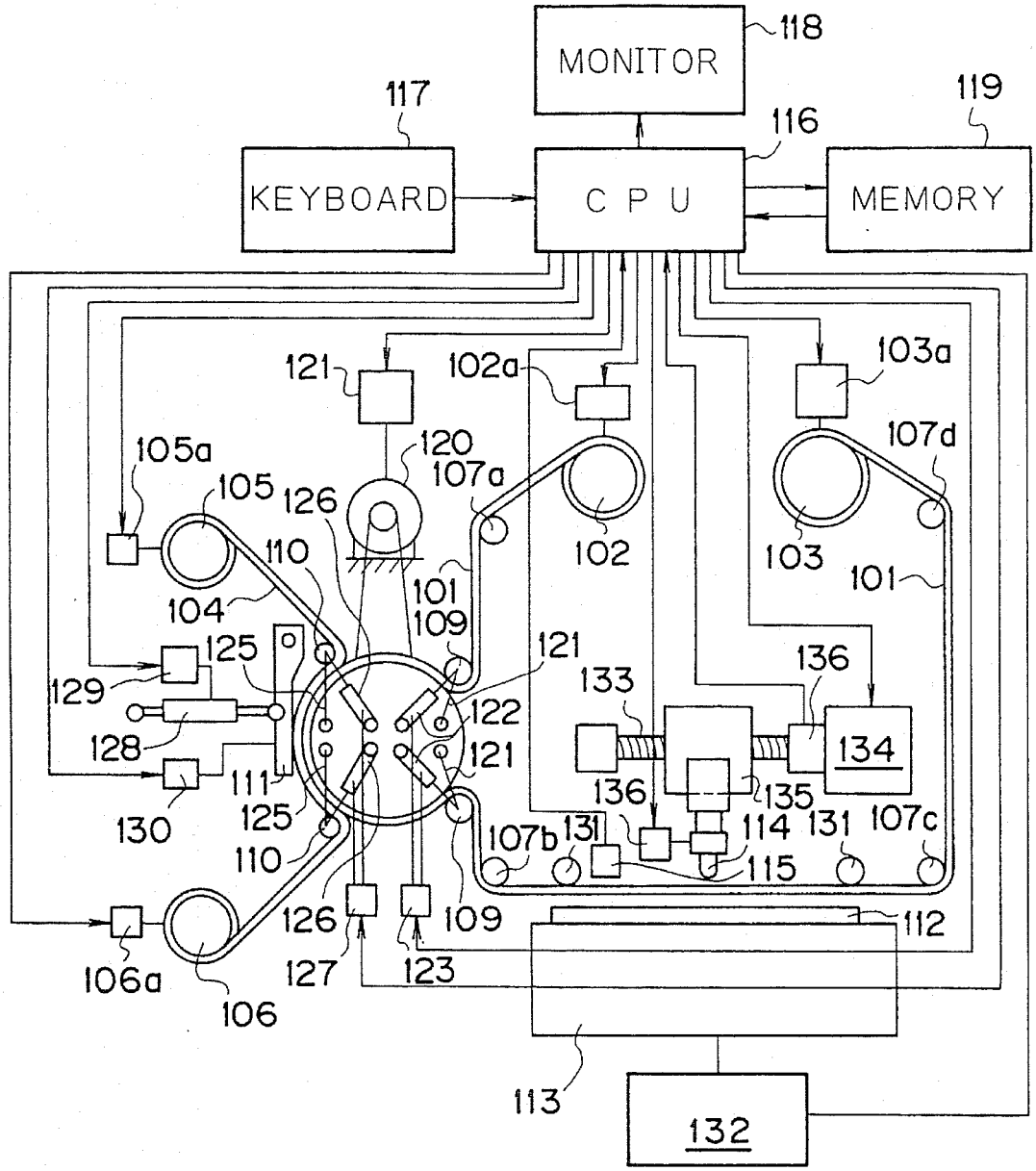
FIG. 18 is a schematic view showing the overall construction of an image transfer device according to another embodiment of this invention.

FIG. 18 is a schematic drawing of an image transfer device according another one embodiment of the invention.

101 is a transfer film having an image layer as a first transfer layer.

102 is a supply reel of a transfer film 101.

103 is a take-up reel of the transfer film 101.

104 is a transfer ribbon having an ink layer as a second transfer layer.

105 is a supply reel of the transfer ribbon 104.

106 is a take-up reel of the transfer ribbon 104.

107*a*, 107*b*, 107*c* and 107*d* are guide rollers.

108 is a rotating drum.

109 are cylinders which function as a film fixing means for fixing the transfer film 101 on the rotating drum 108.

110 are cylinders which fix the transfer ribbon 104 on the transfer film 101 of the rotating drum 108. 111 is a thermal head which functions as a first transfer means.

112 is a card which functions as an object to which an image is transferred.

113 is a stage for mounting the card 112.

114 is a thermal head which functions as a second transfer means for recording on the card 112.

115 is an optical sensor which functions as a transfer part detection means.

116 is a CPU.

117 is a keyboard for inputting information.

118 is a monitor which functions as a display device.

119 is a memory which functions as a storage device.

The transfer film 101 is paid out from the supply reel 102, and is wound on the rotating drum 108 via the guide roller 107*a*. The film 101 wound on the drum 108 is guided by the guide rollers 107*b*, 107*c* and 107, and taken up by the take-up reel 103. The rotation direction and transport speed of the supply reel 102 and take-up reel 103 are determined by the structure of the image elements to be transferred to the card 112 on the stage 113. After transfer data on the card 112 has been read from the CPU 116 into the memory 119, commands are output via interfaces 102*a*, 103*a* to rotate motors at a predetermined rotation speed.

The guide rollers 107*a*, 107*b*, 107*c* and 107*d* are free to rotate. The ribbon 104 is sent to the take-up reel 106 from the supply reel 105. The ribbon 104 has ink regions of different colors, i.e. yellow, magenta, cyan and black, which constitute a second transfer layer.

The rotation of the supply reel 105 and take-up reel 106 in a forward direction is controlled so as to permit transfer of different color inks to the film 101 on the drum 108. This control is performed by a command from the CPU 116 via a drive circuit 105*a* which rotates the supply reel 105, and a drive circuit 105*b* which rotates the take-up reel 106.

For example, if it is desired to transfer yellow ink followed by magenta ink of the ribbon 104 onto the imege layer part 101*a* of film 101 fixed, the cylinders 109,110 and thermal head 111 apart from drum 108, and the reels 102,103 bring the elected image layer part 101*a* of the film 101 to the transfer start position on the drum 108.

Next, the film 101 is fixed on the drum 108 by the pair of cylinders 109, and the supply reels 105, 106 bring the ribbon 104 to the yellow transfer start position, and the pair of cylinders 110 fixes the ribbon 104 on the film 101.

After fixing of the ribbon 104 and film 101 on the drum 108, the thermal head 111 touches with the ribbon 104 by cylinder 128 extending, and the drum 108 and the reels 102,105,103,106 rotate forwords and the thermal head 111 transfers the ink of the ribbon 104 to that a layer part 101*a* of the film 101 by the command of CPU 116.

After completing of transfering yellow ink onto the film 101 from ribbon 104, the cylinder 110 and thermal heads release the film 101, and the drum 108 and the reels 102, 103 are rotated backwards with the cylinder 109.

When the elected image layer part 101*a* of the film 101 has returned to the contact position of the thermal head 111 by backwards rotation of the drum 108, the drum 108 stops backwards rotating, and the supply reel 105 and take-up reel 106 wind up the ribbon 104 so as to bring the start position of magenta onto the elected image layer part 101*a* of the film 101.

After bringing of the ribbon, the pair of cylinders 110 again fix the ribbon 104 on the film 101 and then release the ribbon. After transfer of magenta is complete, the same procedure is repeated to transfer cyan and black.

The drum 108 constitutes a film support roller which is an essential component of the invention. It is driven by a motor 120 via a motor drive circuit 121 connected to the CPU 116, and is rotated in the forward or backward direction by control commands from the CPU 116. According to this embodiment, the rotation torque of the motor 120 is transmitted by a belt, but it may also be transmitted by means of a chain or gear mechanism.

The film fixing means which is an essential component of the invention comprises the pair of cylinders 109, 109 provided on the drum 108. This pair of cylinders 109, 109 extends along the line of the rotation axis of the drum 108, and each of the cylinders is supported by a pair of arms 121 on the left and right of the drum 108. The bases of the arms 121 are supported free to pivot on the side ends of the drum 108, and the free ends of the arms 121 are each supported by one end of four extensible air cylinders 122. The other ends of the air cylinders 122 are supported such that they are free to rotate on the side ends of the drum 108. The extension and contraction of the air cylinders 122,126,128 are controlled by the CPU 116 via an air cylinder drive circuit 123, 127, 129.

Figure 19:
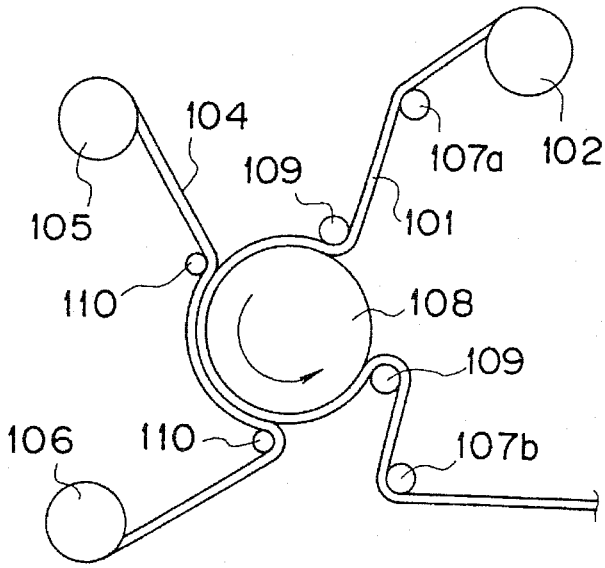
FIG. 19 is a view showing a transfer film and transfer ribbon fixed to a rotating drum.
Figure 20:
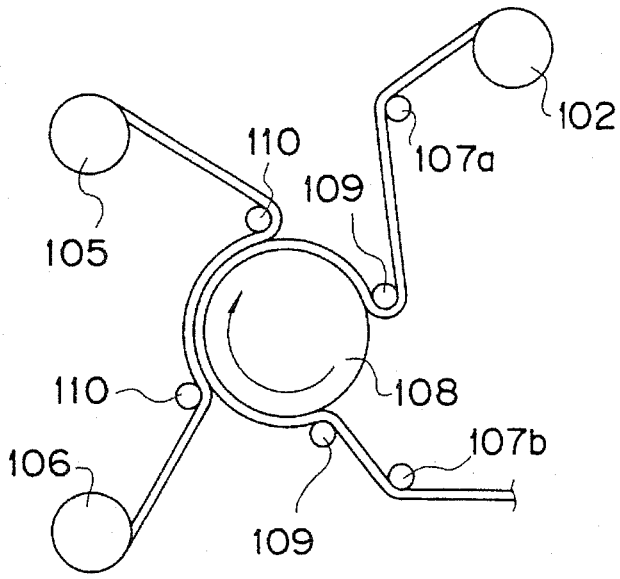
FIG. 20 is another view showing the transfer film and transfer ribbon fixed to the rotating drum.

As shown in FIGS. 19 and 20, when the drum 108 with the film 101 wound around it is rotated forwards or backwards in order to rotate the film 101 and drum 108 together, the air cylinders 122 are contracted by a command from the CPU 116 so as to bring the cylinders 109, 109 into pressure contact with the circumference of the drum 108, thereby fixing the film 101 on the drum 108.

When the film 101 is to be wound on the take-up reel 103 without turning it together with the rotating drum 108, the air cylinders 122 extended, and the film 101 is wound on the take-up reel 103 from the supply reel 102 due to the rotation torque of the take-up reel 103.

The ribbon fixing means which is an essential component of this invention comprises the pair of cylinders 110, 110 parallel to the rotation axis of the drum 108. Each of the cylinders 110, 110 is supported by a pair of arms 125 on the left and right of the drum 108, these arms 125 being supported by four air cylinders 126. The contraction of the air cylinders 126 causes the arms to pivot so as to fix the ribbon 104 on the film 101 such that the ribbon cannot move, the extension of the air cylinders 126 releasing the ribbon 104. The air cylinders 126 are driven via the air cylinder drive circuit 130 by a command signal from the CPU 116.

First and second optical sensors, not shown, are provided on the circumference of the drum 108 in order to position a predetermined area of the image layer on the film 101, and a predetermined area of the ink layer of the ribbon 104. The first optical sensor detects the image layer of the film 101 which is to be transferred, while the second optical sensor detects the ink layer of the ribbon 104.

Light-emitting devices, not shown, are disposed at a small distance from the drum 108 so as to irradiate the first and second optical sensors on the drum 108. The first and second optical sensors detect the light from these devices via the film 101 and ribbon 104 so as to position the predetermined transfer areas of the film 101 and ribbon 104.

Transparent and opaque marks are formed on the film 101 and ribbon 104 so as to identify respective areas which are to be transferred. These transfer areas are identified according to whether the light from the optical devices is transmitted or obstructed by the marks.

The thermal head 111 comprises a first transfer device which is an essential component of this invention. The thermal head 111 transfers an ink layer of the ribbon 104 to the image layer of the film 101 fixed on the circumference of the drum 108. The head 111 has a pivot center at one end, the other end being provided with an array of heat-emitting bodies each of equal size to the image elements to be transferred. One end of an extensible air cylinder 128 is fixed to the middle part of the thermal head 111. The air cylinder 128 extends and contracts by receiving control commands from the CPU 116 via an air cylinder drive circuit 129, and thereby brings the thermal head 111 into contact with or releases it from the surface of the ribbon 104 on the drum 108.

The heat-emitting bodies of the thermal head 111 are disposed in the width direction of and in contact with the ribbon 104 wound on the drum 108, and are controlled to emit heat by the CPU 116 via a drive circuit 130.

The stage 113 comprises a transfer object support device for mounting the card 112 which functions as a transfer object, the card 112 being positioned on the stage 113 in this embodiment by projections which touch the front, rear, left and right edges of the card. An air adsorption hole and a throughhole are provided on the upper surface of the stage 113. An optical sensor for detecting reflected light may be installed in this throughhole for detecting the edges or predetermined areas of the card 112, the card 112 being fixed by aspirating air through the stage.

The film 101 moves above the card 112 on the stage 113. This film 101 is fixed on the upper surface of the stage 113 by a pair of rising and falling pressure rollers 131, 131 driven by an air cylinder drive mechanism, not shown. This pair of pressure rollers 131, 131 and the stage 113 together comprise a positioning means which fixes the positional relationship between the film 101 and the card 112. The stage 113 may be moved in an upward/downward direction by a raising and lowering device 132. This raising and lowering device 132 comprises a guide mechanism which lifts the stage 113 up and down, a gear mechanism which lifts the stage 113 up and down, a motor which provides a driving force and a motor drive circuit which drives the motor. The stage 113 is lifted up and down by control commands from the CPU 116 via this motor drive circuit.

For example, when transporting the film 101 from the supply reel 102 to the take-up reel 103, or when transporting it from the take-up reel 103 to the supply reel 102, the stage 113 is on standby in the lowered position.

When transfer from the ribbon 104 by the thermal head 111, the first transfer device, has been completed, the area on the film 101 to which transfer has been completed is transported above the card 112 on the stage 113, and when this area on the film 101 is detected by the optical sensor 115, the rotation of the supply reel 102 and take-up reel 103 is stopped.

At the same time, the pair of pressure rollers 131, 131 are moved onto the stage 113, and the film 101 is fixed by means of the stage 113 and the pair of rollers 131, 131. Once the film 101 has been fixed on the stage 113, the stage 113 is lifted by means of the raising and lowering device 132, and the transfer area of the film 101 is transferred to the upper surface of the card 112 by the thermal head 114 situated above the stage 113.

The thermal head 114, the second transfer device, is provided with heat-emitting bodies on its end surface, these bodies being aligned in the width direction of the film 101. The thermal head 114 is provided with a ball screw 133, a motor 134 which rotates the ball screw 133 forwards or backwards via a gear mechanism, and a slider 135 which engages with the ball screw 133 such that it is displaced in the longitudinal direction of the film 101 by the rotation of the screw 133.

The thermal head 114 is supported by this slider 135. A plurality of heat-emitting bodies are formed in the width direction of the film 101 on the lower end of the thermal head 114, the heating state of these bodies being controlled by the CPU 116 via a drive circuit 136. In its initial state, the thermal head 114 is situated on the front or rear edge of the card 112, which according to this embodiment is on the left of FIG. 1.

The card 112 on the stage 113 is first positioned by means of the positioning projections. The film 101 is fixed on the upper surface of the card 112 by the pressure rollers 131, 131, and when the stage 113 has been lifted by the raising and lowering device 132, the motor 134 is rotated so as to move the slider 135 to the right of the card 112 while passing electric current through the heating bodies of the thermal head 114 on the left of the card 112.

As the pitch with which the heating bodies move with respect to the card 112 is constant depending on the rotation angle of the motor 134, this angle is detected so as to compute the feed pitch, and the heating of the heating bodies is controlled depending on the dot matrix transferred to the card 112. The dot matrix to be transferred to the card 112 is set such that the forward direction of the film 101 is the X axis, and the width direction of the film 101 is the Y axis. The sizes of the image elements comprising the dot matrix in the X and Y axis directions are determined by the sizes of the heating bodies in the X and Y directions. The sequence of transferred image elements in the X axis direction is determined by the rotation angle of the motor, and the sequence of image elements in the Y axis direction is determined by the sequence of heating bodies in the Y axis direction.

Therefore, if there is an IC chip or a magnetic stripe on the upper surface of the card 112 where heating or transfer are prohibited, a transfer prohibition area is set based on its aforesaid X and Y coordinates in the dot matrix to be transferred to the card, and this information is stored in a memory 119.

Figure 21:
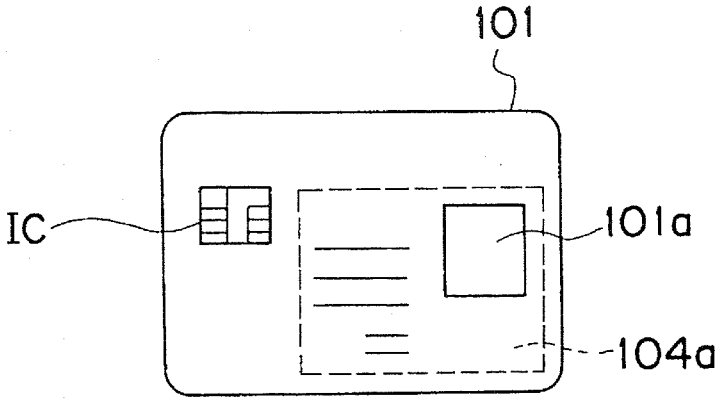
FIG. 21 is a plan view of a card to which images are transferred by the image transfer device according to this embodiment.
Figure 22:
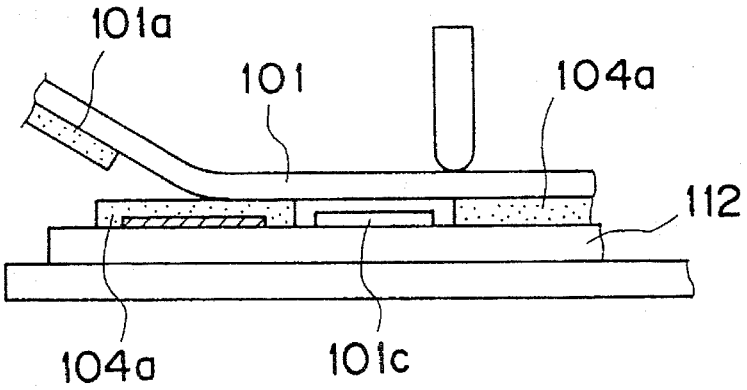
FIG. 22 is a section through a card to which images are transferred by the image transfer device according to this embodiment.

When the image 101*a* shown in FIG. 21 and FIG. 22 is to be transferred to the card 112 fixed on the upper surface of the stage 113, the transfer dot matrix of this card 101 is recalled by the CPU 116 from the memory 119, and the heating bodies are controlled via the drive circuit 136 based on this dot matrix data. For the purpose of this control, the rotation angle of the motor 134 is detected and converted to a pulse count.

Further, even if the temperature of the image layer and the temperature at which the ink of the ink layer is transferred are different, the area of the image layer and the area of the ink layer to be transferred may be set in the dot matrix, and the voltage applied to the heating bodies in these respective areas varied so as to obtain optimum transfer conditions.

The drive mechanism comprises the aforesaid raising and lowering device 132 of the stage 113, the ball screw 133, the motor 134 and the slider 135. However, as the sliding of the thermal head 114 is relative, it is also possible to slide the stage 113, or to raise or lower the thermal head 114.

According to the image transfer device of this embodiment, transfer of the image by the thermal head 111 takes place when the film 101 is wound on the drum 108, the film 101 is pressed on the drum 108 by the pair of cylinders 109, 109, and the ribbon 104 is brought into contact with and fixed on the film 101 on the drum 108 by the pair of cylinders 110, 110.

After the transfer layers of the ribbon 104 are transferred by the thermal head 111 to the film 101, the film 101 is transported to the stage 113 and the thermal head 114 is heated. The image transfer layer and the ink layer are then transferred to the card 112.

The heating bodies of the thermal head 114 are arranged in the width direction of the film 101. Thus, if the thermal head 114 is slid in the longitudinal direction of the film 101 while the film and card 112 are supported together, and the heating area of the thermal head 114 is controlled to coincide with the slide pitch, a predetermined transfer can be performed avoiding an IC area in the case of a card 112 with an IC as shown in FIG. 21.

What we claim is:

1. An image transfer device comprising:

transport means for transporting a film having at least a first transfer layer on a support, image writing means for bringing a transfer ribbon into contact with said first transfer layer of said film, and transferring transfer ink on said ribbon to said first transfer layer by a thermal head so as to form an image on said first transfer layer, a stage for fixing a transfer object, transfer means for guiding said film whereon said image has been formed on said first transfer layer by said ribbon onto said object on said stage, and transferring said image on said first transfer layer to said object by heating and applying pressure to said object by way of said film by a transfer roller, a peel roller for peeling said support of said film adhering to said transfer object from said object downline from where said film passes over said transfer roller, said peel roller being disposed in the vicinity of said transfer roller, and a pressure roller which is free to rotate and which presses said film onto said stage, said pressure roller being provided between said transfer roller and said peel roller.

2. An image transfer device as defined in claim 1 wherein said stage is provided with a plurality of supports, each of the supports having a shape depending on a shape of said transfer object, and said transfer roller comprises a plurality of transfer rollers of different shapes depending on shapes of said transfer objects.

3. An image transfer device as defined in claim 1 wherein said transfer means comprises:

a movable frame which can move in a straight line on said stage, a transfer roller supported by said movable frame having a small diameter surface separated from a surface of said transfer object, and a pressure surface which applies heat and pressure to said transfer film on said transfer object, a rack provided on a movable frame of said image transfer device, said rack extending in a direction of motion of said movable frame, and a pinion connected to a side of said transfer roller which engages with said rack, and which rotates said transfer roller when said frame moves.

4. An image transfer device as defined in claim 1 wherein said transfer means comprises:

a movable frame which can move in a straight line on said stage, a transfer roller supported by said movable frame having a small diameter surface separated from a surface of said transfer object, and a pressure surface which applies heat and pressure to said transfer film on said object, a rack provided on a movable frame of said image transfer device, said rack extending in a direction of motion of said movable frame, a pinion connected to a side of said transfer roller which engages said rack, and which rotates said transfer roller when said frame moves, a swing mechanism attached to said transfer roller which swings said transfer roller away from or closer to said transfer object, and a gear mechanism which permanently connects said pinion to said transfer roller when said transfer roller is moved by said swing mechanism.

5. An image transfer device as defined in claim 1 wherein said transfer roller of said transfer means has a central part whose surface is a concave pressing surface and whose diameter is smaller than that of both side ends of said roller.

6. An image transfer device as defined in claim 1 wherein said transfer roller of said transfer means has a central part whose diameter is smaller than that of both side ends and whose surface is a concave pressing surface, said pressing surface being coated with a fluorinated polymer compound.

7. An image transfer device as defined in claim 6 wherein said fluorinated polymer compound is polytetrafluoroethylene.

8. An image transfer device as defined in claim 6 wherein said fluorinated polymer compound is a copolymer of tetrafluoroethylene and perfluoroalkylvinylether.

9. An image transfer device as defined in claim 6 wherein said fluorinated polymer compound has been given electrical conduction properties by admixture of an electrically conducting filler.

10. An image transfer device as defined in claim 1 wherein said transfer roller of said transfer means comprises a roller body having a cylindrical shape and a halogen lamp heater disposed inside said roller body, a inner surface of said roller body being blackened.

11. An image transfer device comprising:

transport means for transporting a transfer film having at least a support and a first transfer layer, image writing means for bringing a transfer ribbon into contact with said first transfer layer of said film, and transferring transfer ink on said ribbon to said first transfer layer by a thermal head so as to form an image on said layer, a stage for fixing a transfer object, and transfer means for guiding said film whereon said image has been formed on said first transfer layer by said ribbon onto said object on said stage, and transferring said image on said film to said object by heating and applying pressure to said object by way of said film by a transfer roller, wherein a peel roller for peeling said support of said film adhering to said transfer object from said object downline from where said film passes over said transfer roller, is disposed in the vicinity of said transfer roller, said image writing means is provided with a film support member for supporting said transfer film when said transfer ribbon is brought into contact with said first transfer layer of said transfer film so that said transfer ink on said transfer ribbon is transferred to said first transfer layer by said thermal head, and said film support member is provided with a main body having a predetermined rigidity, an elastic layer disposed on said main body and a cover layer disposed on said elastic layer, said elastic layer consisting of a silicone elastomer and said cover layer consisting of a heat-resistant polymer compound.

12. An image transfer device as defined in claim 11 wherein said heat-resistant polymer compound is polytetrafluoroethylene.

13. An image transfer device as defined in claim 11 wherein said heat-resistant polymer compound is a copolymer of tetrafluoroethylene and perfluoroalkylvinylether.

14. An image transfer device as defined in claim 11 wherein said heat-resistant polymer compound is polyethylenenaphthalate.

15. An image transfer device as defined in claim 11 wherein said heat-resistant polymer compound is a polyimide, polyamidoimide or polyetherimide.

16. An image transfer device as defined in claim 11 wherein said heat-resistant polymer compound is polyphenylenesulfide.

17. An image transfer device as defined in claim 11 wherein said cover layer is given electrical conduction properties by admixture of an electrically conducting filler.

18. An image transfer device as defined in claim 11 wherein said main body is formed in a cylindrical shape.

19. An image transfer device as defined in claim 11 wherein said main body is formed in a flat shape.

20. An image transfer device comprising:

a transfer film having at least a support and a first transfer layer, a transfer ribbon having a transfer ink layer for transferring ink to a surface of said transfer film on which said first transfer layer on said transfer film is formed, a support roller for winding said transfer film on an outer circumference thereof such that said first transfer layer is exposed, transfer film fixing means which rotates together with said support roller, and which presses said transfer film wound on said roller onto or releases it from the surface of said roller, transfer ribbon guide means which brings an area where said transfer ink layer of said transfer ribbon is formed, into contact with the surface on which said first transfer layer of said transfer film fixed on said support roller by said fixing means is formed, said guide means being free to rotate together with said support roller, image writing means for transferring said transfer ink layer of said transfer ribbon to said transfer film fixed on the outer circumference of said support roller, a stage for mounting said transfer film on which image writing has been completed by said image writing means, on a transfer object, and secondary transfer means comprising a row of heating bodies spaced apart at small pitch intervals in at least the width direction of said transfer film and facing said stage on which said transfer film is mounted, said heating bodies being caused to emit heat according to image element information so as to transfer said first transfer layer to said transfer object.

21. An image transfer device as defined in claim 20 wherein said secondary transfer means further comprises:

detection means for detecting an area of said transfer film where secondary transfer is to be performed, and aligning said area with the surface of said transfer object, positioning means for fixing the positional relationship between said transfer film and said transfer object when said detection means has detected that said area of said transfer film is correctly aligned with the surface of said transfer object, a thermal head for transferring said first transfer layer and transfer ink layer on said transfer film to said transfer object according to information relating to said transfer object, after said positioning means has correctly positioned said transfer film and said transfer object relative to one another, and a drive mechanism which moves said thermal head closer to or further from, and which can slide relative to, said transfer film and said transfer object whereof the positions have been determined when said transfer is performed by said thermal head.

22. An image transfer device as defined in claim 20 wherein said support roller is provided with a main body having a predetermined rigidity, an elastic layer disposed on said main body and a cover layer disposed on said elastic layer, said elastic layer consisting of a silicone elastomer and said cover layer consisting of a heat-resistant polymercompound.

23. An image transfer device as defined in claim 20 wherein said support roller is provided with a main body having a predetermined rigidity, an elastic layer disposed on said main body and a cover layer disposed on said elastic layer, said elastic layer consisting of a silicone elastomer, said cover layer consisting of a heat-resistant polymer compound and said heat-resistant polymer compound being polytetrafluoroethylene.

24. An image transfer device as defined in claim 20 wherein said support roller is provided with a main body having a predetermined rigidity, an elastic layer disposed on said main body and a cover layer disposed on said elastic layer, said elastic layer consisting of a silicone elastomer, said cover layer consisting of a heat-resistant polymer compound and said heat-resistant polymer compound being a copolymeroftetrafluoroethyleneandperfluoroalkylvinylether.

25. An image transfer device as defined in claim 20 wherein said support roller is provided with a main body having a predetermined rigidity, an elastic layer disposed on said main body and a cover layer disposed on said elastic layer, said elastic layer consisting of a silicone elastomer, said cover layer consisting of a heat-resistant polymer compound and said heat-resistant polymer compound being polyethylenenaphthalate.

26. An image transfer device as defined in claim 20 wherein said support roller is provided with a main body having a predetermined rigidity, an elastic layer disposed on said main body and a cover layer disposed on said elastic layer, said elastic layer consisting of a silicone elastomer, said cover layer consisting of a heat-resistant polymer compound and said heat-resistant polymer compound being a polyimide, polyamidoimide or polyetherimide.

27. An image transfer device as defined in claim 20 wherein said support roller is provided with a main body having a predetermined rigidity, an elastic layer disposed on said main body and a cover layer disposed on said elastic layer, said elastic layer consisting of a silicone elastomer, said cover layer consisting of a heat-resistant polymer compound and said heat-resistant polymer compound being polyphenylenesulfide.

28. An image transfer device as defined in claim 20 wherein said support roller is provided with a main body having a predetermined rigidity, an elastic layer disposed on said main body and a cover layer disposed on said elastic layer, said elastic layer consisting of a silicone elastomer, said cover layer consisting of a heat-resistant polymer compound and said cover layer being given electrical conduction properties by admixture of an electrically conducting filler.

* * * * *